United States Patent [19]

Balthis et al.

[11] Patent Number: 4,485,066

[45] Date of Patent: Nov. 27, 1984

[54] METHOD OF MAKING ELASTOMER-COATED HOT ROLL

[75] Inventors: Vernon M. Balthis, Boulder; Howard E. Evans; James C. Minor, both of Longmont, all of Colo.

[73] Assignee: International Business Machines Corporation, Armonk, N.Y.

[21] Appl. No.: 464,820

[22] Filed: Feb. 8, 1983

[51] Int. Cl.[3] ..... B44D 5/00

[52] U.S. Cl. ..... 264/341; 264/233

[58] Field of Search ..... 264/232, 233, 341; 525/474

[56] References Cited

U.S. PATENT DOCUMENTS

| | | | |
|---|---|---|---|
| 2,858,237 | 10/1958 | Walles et al. | 525/474 |
| 3,848,305 | 11/1974 | Jachimiak | 29/132 |
| 4,000,339 | 12/1976 | Murphy | 427/194 |
| 4,110,068 | 8/1978 | Brown et al. | 432/60 |
| 4,188,423 | 2/1980 | Swift | 427/444 |

*Primary Examiner*—Donald Czaja
*Assistant Examiner*—Mary A. Becker
*Attorney, Agent, or Firm*—Francis A. Sirr

[57] ABSTRACT

A hot roll, for use in a xerographic hot roll fuser, is made by coating a hollow aluminum cylinder with an elastomer, as by the use of an injection molding machine. After molding, the external surface of the elastomer cylinder is ground slightly to improve its concentricity. Thereafter, this ground external surface is subjected to the chemical influence of an acid. After a predetermined time period, the acid treatment is terminated and the roll is washed in water. The resulting hot roll, whose external surface has been chemically modified, possesses improved dry-release properties.

8 Claims, No Drawings

METHOD OF MAKING ELASTOMER-COATED HOT ROLL

DESCRIPTION

TECHNICAL FIELD

This invention relates to the field of xerography, and to the fusing of toner onto paper substrate by the use of a hot roll fuser.

BACKGROUND OF THE INVENTION

One of the more important properties of a xerographic hot roll fuser is its ability to resist the adhesion of toner/paper to the hot surface of the roll, as the paper exits the fusig nip.

Silicone elastomers are well known in the xerographic art as suitable materials for use as fuser rolls. It is also known that these elastomers may be compounded with filler materials, such as oxides of silicon, iron and aluminum, in order to provide improved physical strength and thermal conductivity. These fillers, while generally desirable, are also known to inhibit release of the paper/toner from the hot elastomer, as the paper exits the fusing nip.

Two general types of such hot roll fusers are wet-release and dry-release fusers.

Dry release fusers have the advantage that fuser oil is not required as a consumable product within the copier device, and the resulting copy paper does not appear to have an oil-like coating. However, the dry-release fuser technology may result in greater difficulty in getting the molten toner to release from the hot elastomer surface as the copy sheet exits the fusing nip.

U.S. Pat. No. 3,848,305 is a particularly good example of a way in which the dry-release fuser technology has been advanced by a manufacturing technique which subjects the roll's silicone elastomer to heat and vacuum curing, in order to remove the cyclic siloxanes known to cause failure of the paper and its toner to release from the roll's surface.

U.S. Pat. No. 4,188,423 is also of interest. In this patent, it is suggested that the hot roll's silicone rubber layer be subjected to a solvent in order to remove siloxanes, polysiloxanes and other impurities from the rubber. More specifically, this patent states that the solvent must be of the type which does not react with, degrade or dissolve the silicone rubber.

Both of these prior art patents are incorporated herein by reference for the purpose of illustrating the state of the art and the background of the present invention.

THE INVENTION

The present invention relates to the art of hot roll fusing, and more particularly to an improved method of treating the roll's elastomeric surface to improve paper/toner release. Since dry release fusing rolls generally require lower surface energy, the present invention has special utility in the art of dry-release hot roll fusing.

U.S. Pat. No. 4,110,068 is incorporated herein by reference for the purpose of disclosing a dry-release fuser mechanism in which the present invention finds utility.

It has been found that a short time period of exposure of the roll's silicone elastomeric sleeve to a strong elastomer solvent (i.e., a material which dissolves the sleeve's external surface) causes the surface energy of the fusing surface to decrease, and thus its release properties are improved. This is thought to be accomplished by reforming of the elastomer, accompanied by a skinning effect, which results in little or no filler material on the fusing surface, thereby leaving the filler to do its intended function of providing mechanical strength and thermal conductivity, without inhibiting paper/toner release.

In a preferred embodiment, trifluoroacetic acid ($CF_3COOH$), an organic, strong acid, is allowed to contact the elastomer for a short period of time. The acid is then immediately washed off the roll. The reformed elastomer is allowed to dry. While the mechanism by which the present invention produces reduced surface energy is not known, it is thought that it may result from the transposition of surface filler particles to the underlying portion of the elastomer during the solvation process, i.e., while the elastomer is in contact with the acid.

Sulphuric acid ($H_2SO_4$), an inorganic strong acid, and acetic acid ($CH_3COOH$), an organic weak acid, are also solvents to the elastomer. However, they provide less reduction in the elastomer's surface energy than does trifluoroacetic acid, probably due to the fact that these two acids are weaker acids, and have smaller dissociation constants. We have found that the weaker the acid, the longer is the solvation-process time interval required in the practice of the present invention.

It has been found, using contact-angle measurement, that elastomers treated in accordance with the present invention have markedly lower surface energy than does the untreated elastomer. It has also been found, using electron microscope techniques, that elastomers treated in accordance with the present invention have a smoother surface than does untreated elastomer. This later observation discloses that filler particles are covered by the treated elastomer. While surface topography can have some effect on surface energy, as measured by the contact-angle technique, the surface energy change which results from operation of the present invention is much more than would be expected from the observed topographic change.

Numerous silicone elastomers are mentioned in the art of hot roll fusing. RTV-60 by General Electric Company, Sylgard 170A and B by Dow Corning Corporation, and LTV (low temperature vulcanization), as well as HTV (high temperature vulcanization) silicone rubbers are mentioned.

In the practice of the present invention, the method of making the hot roll per se is not critical. Conventional injection molding techniques are preferred.

An exemplary fuser roll may comprise a center, circular-cylinder aluminum core, about 15 inches long and 3 inches diameter. When used in a xerographic device, means are provided to rotationally support this core on its cylinder axis.

The silicone elastomer is injection molded, about this core, to form a uniform-thickness sleeve, about 0.065 inch thick. After molding, the sleeve's outer surface is ground, primarily to produce a true circular cylinder. Grinding usually removes about 0.015 inch from the sleeve's outer surface.

The brand Silastic 590 (Dow Corning Corporation), a polydimethyl siloxane, is the preferred silicone elastomer for use with the present invention. This commercial product includes silica as filler material. The major variation between commercially available silicone elastomers is generally in the use of different amounts and- /or types of filler materials. Thus, the present invention is not to be limited to use of this particular elastomer. Any type of filled silicone elastomer is usable in the present invention.

In the practice of the present invention, a Silastic-brand-coated hot roll was subjected to (i.e., placed in a solution of) trifluoroacetic acid, of full strength, for about one minute. Thereafter, the roll was water-washed, or flushed, to remove all residual acid. The method or time of washing is not critical, provided all acid is removed from the elastomer. Thereafter, the roll was supported by its shaft ends, with the elastomer completely exposed to room-temperature air (22° C.). The drying interval is not critical, and is for the primary purpose of removing all water from the roll. Thereafter, the roll was ready for use.

The time period of solvation must be long enough to allow the surface chemistry of the sleeve to change, causing the filler particles to migrate into the bulk of the elastomer and away from its outer surface; and yet this time period must not be so long that the elastomer actually goes into solution, a result that can be observed by a reduction in the final roll's circumference and diameter.

When using the solvent $H_2SO_4$, of full strength, the solvation time period was increased to about 60 minutes; and the still weaker acetic acid, of full strength, required a solvation time period of about 180 minutes.

While room-temperature solvation by these latter two weaker acids produced a reduction in the elastomer's surface energy, the reduction was not as large as when using the trifluoroacetic acid solvent.

The following table shows the contact-angle measurements, in degrees, resulting from testing three samples of unsolvated Silastic brand elastomer and three samples of solvated Silastic brand elastomer, first using a mineral oil bead, and then a water bead.

| Untreated | | | Treated | | |
|---|---|---|---|---|---|
| Mineral Oil | | | Mineral Oil | | |
| 65.5 | 65.5 | 67.0 | 51.0 | 52.5 | 51.0 |
| Water | | | Water | | |
| 137.5 | 137.0 | 136.0 | 101.0 | 102.0 | 103.0 |

From these readings, those skilled in the art of hot roll fusing will agree that the treated rolls, of lower surface energy, will exhibit a greater propensity to reliably release toner/paper from the hot roll's fusing nip.

While the invention has been particularly shown and described with reference to preferred embodiments thereof, it will be understood by those skilled in the art that various changes in form and details may be made therein without departing from the spirit and scope of the invention.

What is claimed is:

1. In a method of making a xerographic hot roll, for use in a hot roll fuser, wherein a filler-containing elastomeric sleeve is ground to form a generally circular-cylinder shape, the improvement comprising:

treating the ground external surface of the sleeve with a strong elastomer-solvent, which dissolves said external surface, to thereby cause a filler-free external surface skin to form on said sleeve, thereby improving the sleeve's paper/toner release property.

2. The method of claim 1 wherein the solvent is an acid.

3. The method of claim 1 wherein the elastomer is a silicone and the solvent is trifluoroacetic acid.

4. The method of claim 3 wherein the elastomer is a filler-containing polydimethyl siloxane, including the steps of subjecting said elastomer to full-strength acid for about one minute, and then water-washing said elastomer to remove the acid, followed by drying said elastomer.

5. The method of claim 2 wherein the acid is selected from the group sulphuric, acetic or trifluoroacetic acid.

6. The method of claim 2 wherein the elastomer is a silicone.

7. The method of claim 6 wherein the elastomer is a filler-containing polydimethyl siloxane includes silica as filler, including the steps of subjecting said elastomer to said acid for about one minute, and then water-washing said elastomer to remove the acid, followed by drying said elastomer.

8. The method of claim 1 wherein the elastomer is a silicone and the solvent is trifluoroacetic acid, and wherein the step of treating the external surface of the sleeve comprises subjecting the sleeve to said acid for a period of about one minute, at a temperature of about 22° C., followed by a water-wash of said sleeve.

* * * * *